US010039380B2

(12) United States Patent
Pitts et al.

(10) Patent No.: US 10,039,380 B2
(45) Date of Patent: Aug. 7, 2018

(54) MODULAR LOCKER STRUCTURE

(71) Applicant: International Vending Management, Inc., Indianapolis, IN (US)

(72) Inventors: Michael Pitts, Fishers, IN (US); Nathan Guffey, Greencastle, IN (US); William Ott, Indianapolis, IN (US); Dustin Norvell, Homer, IN (US); Woody Akalu, Indianapolis, IN (US); Jon Crowe, Fishers, IN (US); David R Sutton, Sheridan, IN (US); Tyler G Sutton, Westfield, IN (US)

(73) Assignee: International Vending Management, Inc., Indianapolis, IN (US)

( * ) Notice: Subject to any disclaimer, the term of this patent is extended or adjusted under 35 U.S.C. 154(b) by 20 days.

(21) Appl. No.: 15/008,545

(22) Filed: Jan. 28, 2016

(65) Prior Publication Data

US 2017/0215580 A1 Aug. 3, 2017

(51) Int. Cl.
*A47B 47/00* (2006.01)
*A47G 29/14* (2006.01)

(52) U.S. Cl.
CPC ..... *A47B 47/0091* (2013.01); *A47G 29/141* (2013.01); *A47B 2220/0091* (2013.01); *A47B 2230/0037* (2013.01)

(58) Field of Classification Search
CPC ..... A47B 47/0091; A47B 2220/0091; A47B 2230/0037; A47G 29/141
USPC ..... 700/231; 312/107
See application file for complete search history.

(56) References Cited

U.S. PATENT DOCUMENTS 2,429,294 A * 10/1947 Pollock ..... F25D 19/02 312/107
5,147,120 A * 9/1992 Ray ..... A47B 17/00 211/194
5,240,264 A * 8/1993 Williams ..... B62B 3/006 211/194
6,499,817 B2 12/2002 Jermain
6,585,504 B2 7/2003 Weiss
7,689,316 B1 * 3/2010 Frederick ..... G06F 19/327 700/231
7,758,276 B2 * 7/2010 Miura ..... B65D 21/0204 361/726
7,845,653 B2 * 12/2010 Katz ..... B25H 3/023 206/507

(Continued)

FOREIGN PATENT DOCUMENTS

GB 2437967 A 11/2007
GB 2522726 A 8/2015
WO 2012078952 A2 6/2012

OTHER PUBLICATIONS

Quotation of one-card Control System for Intelligence-intensive, Shenzhen Red Leaf Locks Technology Development Co., Ltd., Shen zhen, China, Publication date unknown, 15 pages.

(Continued)

*Primary Examiner* — Michael Collins
(74) *Attorney, Agent, or Firm* — Barnes & Thornburg LLP

(57) ABSTRACT

A modular locker system can include a locker base, a locker tower, and a modular locker. The modular locker system allows different sized modular lockers to be interchanged to achieve a number of modular locker configurations. The contents of the modular lockers can be accessed by inputting a code to unlock a door included in the modular locker.

21 Claims, 8 Drawing Sheets

(56) References Cited

U.S. PATENT DOCUMENTS 8,412,375 B2 * 4/2013 Schifman ..... G07F 11/62 700/232
8,423,180 B1 * 4/2013 Frederick ..... G06Q 10/087 700/236
8,812,153 B2 * 8/2014 Reckelhoff ..... A61G 12/001 700/243
9,081,886 B2 * 7/2015 Schifman ..... G07F 11/62
9,367,061 B2 * 6/2016 Miller ..... G05B 19/042
9,367,984 B2 * 6/2016 Daugbjerg ..... G06F 19/3462
9,433,284 B2 * 9/2016 Miranda ..... A47B 47/0091
2002/0074905 A1 * 6/2002 Tiramani ..... B25H 3/00 312/108
2002/0171332 A1 * 11/2002 Skov ..... A47B 87/0276 312/107
2003/0025425 A1 2/2003 Cheng
2005/0275234 A1 * 12/2005 Ottenthal ..... B60P 3/03 296/10
2007/0193318 A1 8/2007 Churchill et al.
2008/0180007 A1 7/2008 Quinn
2008/0264962 A1 * 10/2008 Schifman ..... G07F 11/62 221/1
2011/0084577 A1 * 4/2011 Leatherman ..... A47B 47/0091 312/100
2012/0203377 A1 * 8/2012 Paydar ..... G01K 3/005 700/232
2012/0209763 A1 8/2012 Zabbatino
2013/0178977 A1 * 7/2013 Schifman ..... G07F 11/62 700/237
2014/0229003 A1 * 8/2014 Stoffel ..... B25H 3/00 700/237
2015/0179006 A1 6/2015 Von Zurmuehlen et al.
2015/0345180 A1 12/2015 Guelzow et al.
2016/0066732 A1 * 3/2016 Sarvestani ..... A47G 29/1201 232/24
2016/0095429 A1 * 4/2016 Miranda ..... A47B 47/0091 312/265
2016/0275735 A1 * 9/2016 Carstens ..... A47G 29/141
2017/0033579 A1 * 2/2017 Maguire ..... H02J 7/0044
2017/0164735 A1 * 6/2017 Lin ..... A47B 57/00
2017/0215580 A1 * 8/2017 Pitts ..... A47B 47/0091
2017/0299249 A1 * 10/2017 Dade ..... F25D 13/04

OTHER PUBLICATIONS

International Vending Machine Tech Manual, published Dec. 22, 2011, 21 pages.
Transmittal of International Search Report, International Search Report, and International Written Opinion in Related Application PCT/US2017/015008 dated May 1, 2017, 17 pages.

* cited by examiner

MODULAR LOCKER STRUCTURE

BACKGROUND

The present disclosure relates to a modular locker system. More specifically, the present disclosure relates to a locker system including interchangeable modular lockers.

SUMMARY

The present disclosure includes one or more of the features recited in the appended claims and/or the following features which, alone or in any combination, may comprise patentable subject matter.

According to the present disclosure, a modular locker system may include a locker base, a locker tower, and a modular locker. The locker tower may be supported by the locker base. The modular locker may be located within the locker tower and may be secured to the locker tower with a set of locking rods that extend vertically down through a locker tower upper compartment located at a top of the locker tower through the modular locker. In some embodiments, the set of locking rods may be removable to allow the modular locker to be removed from the locker tower.

The modular locker system may include a lock control unit. In one aspect, the modular locker may include a door, a locker compartment formed to include an interior product storage region, and a lock assembly configured to release the door from the locker compartment in response to a signal received from the lock control unit to allow a user to access the interior product storage region.

In some embodiments, the locker compartment may include a first locker side wall located in spaced-apart relation to a second locker side wall, and a locker bottom arranged to extend between and interconnect the first locker side wall and the second locker side wall.

In some embodiments, each of the first locker side wall and the second locker side wall may include a L-shaped locker tower mount located on a front face of the locker compartment configured to horizontally locate the modular locker within the locker tower. Illustratively, each of the first locker side wall and the second locker side wall may further include a rail extending from the front face of the modular locker to the rear of the modular locker to vertically locate the modular locker within the locker tower.

In some embodiments, the L-shaped locker tower mount may include a first segment and a second segment. The first segment may be coupled to the locker compartment and extend horizontally away from the locker compartment. The second segment can be coupled to the first segment and extend rearwardly from the front face of the modular locker towards a back wall of the locker tower to locate a portion of a notched inner side wall between the second segment and the locker compartment.

In some embodiments, the rail may be coupled generally perpendicularly along a top edge of the first locker side wall. The rail may include a front segment, a rear segment, and a middle segment. The middle segment may be configured to extend between and interconnect the front segment with the rear segment. The front segment may be formed to include a locking rod aperture configured to locate a portion of a locking rod of the set of locking rods therein.

It is contemplated that the rail may extend horizontally away from the locker compartment towards a notched inner side wall of the locker tower so that the middle segment lies within a rail receiver to vertically support the modular locker.

In some embodiments, the rail receiver of the notched inner side wall may include a top edge and a bottom edge. The top edge and the bottom edge may be arranged to locate a portion of the rail therebetween.

In some embodiments, the locker compartment can further include a compartment brace that extends between the first locker side wall and the second side wall.

In some embodiments, the locker bottom can be formed to include an aperture configured to receive a portion of a locking rod of the set of locking rods to secure the modular locker within the locker tower.

In some embodiments, the modular locker system can further include an electrical outlet coupled to the second locker side wall.

In some embodiments, the lock assembly may include a lock including a latch and a rod, and a lock cover mounted over the lock to locate the lock between the lock cover and a side wall. It is contemplated that the rod may be configured to apply a force to the door to partially open the door when the latch releases the door.

In some embodiments, the door may be coupled to a front face of the locker compartment with a hinge to form a locked angle that is about 90 degrees relative to second side wall of the locker compartment.

In some embodiments, the door and second side wall form a locking angle that is generally less than the locked angle to latch the door to the lock assembly.

In some embodiments, the locker tower may include a back wall, a first notched inner side wall, and a second notched inner side wall. It is contemplated that each of the first notched inner side wall and the second notched inner side wall may be configured to receive a rail from the modular locker to locate the modular locker between the first notched inner side wall and the second notched inner side wall.

In some embodiments, the locker tower further may include a locker tower floor located between a bottom edge of the first notched inner side wall and the locker base. In some embodiments, the locker tower upper compartment may be located in spaced-apart relation to the locker tower floor to locate the modular locker between the locker tower floor and the locker tower upper compartment.

In some embodiments, the first notched inner side wall and the second notched inner side wall may each include a plurality of rail receivers that extend in a rearward direction from a front of the locker tower to the back wall of the locker tower. It is contemplated that the rail receivers may be equidistantly spaced-apart between the locker tower floor and the locker tower upper compartment.

In some embodiments, the locker tower upper compartment may include an upper compartment lid and a compartment floor located between the upper compartment lid and the locker tower. Illustratively, the upper compartment lid and the compartment floor may cooperate to form an upper compartment storage region.

In some embodiments, the modular locker system may further include a lock control unit located within the upper compartment storage region and coupled to a portion of the compartment floor.

In some embodiments, the locker tower may further include a user control unit located on an outer side wall.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which:

FIG. 12 shows the door arranged in the open position P1;

FIG. 13 shows the door arranged in the the locking position P2 with the lock assembly;

FIG. 14 shows the door and the lock assembly in the locked position P3;

DETAILED DESCRIPTION

Figure 1:
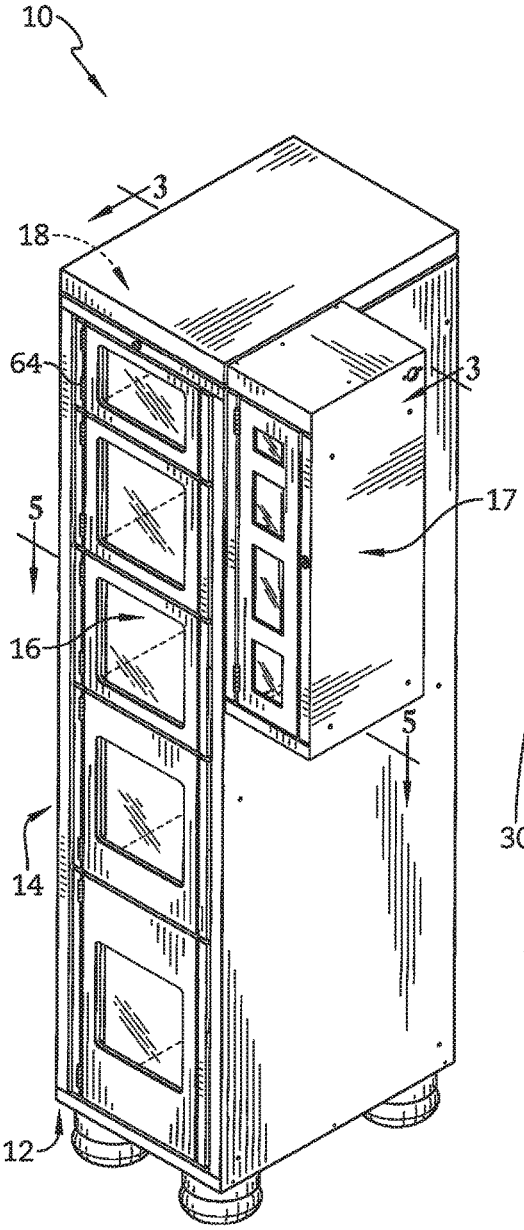
FIG. 1 is a perspective view of a modular locker system with an optional control unit.
Figure 2:
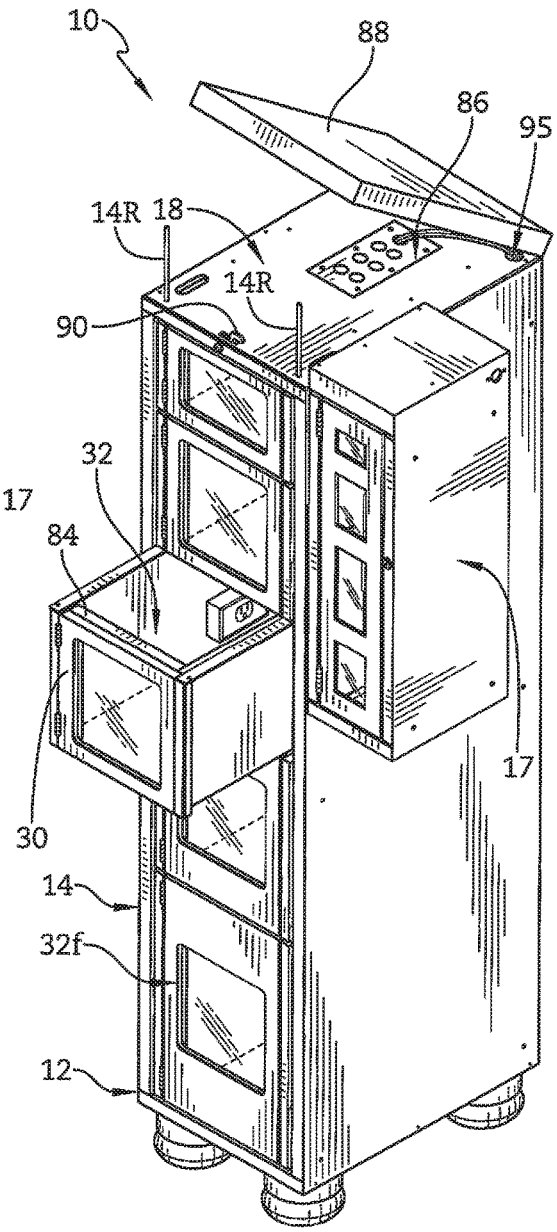
FIG. 2 is a perspective view of the modular locker system of FIG. 1 showing an open upper compartment and a modular locker positioned to be inserted into the locker tower.
Figures 3, 4:
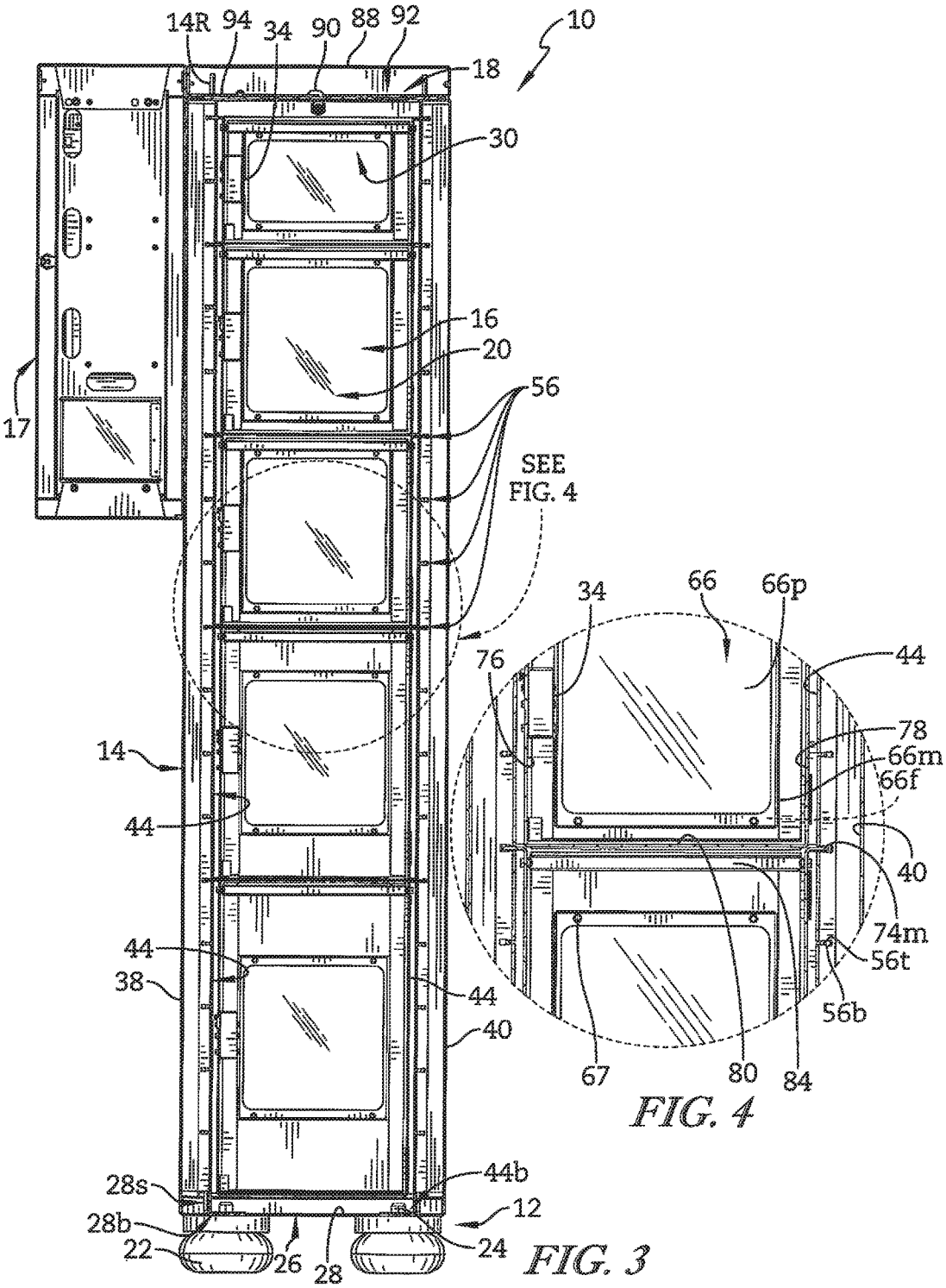
FIG. 3 is a cross-sectional view looking from the rear at the modular locker system of FIG. 1 taken along line 3-3 of FIG. 1.
FIG. 4 is a detail view of the cross-sectional view of FIG. 3 showing the interaction of the rail and the rail receiver.
Figures 12, 13, 14:
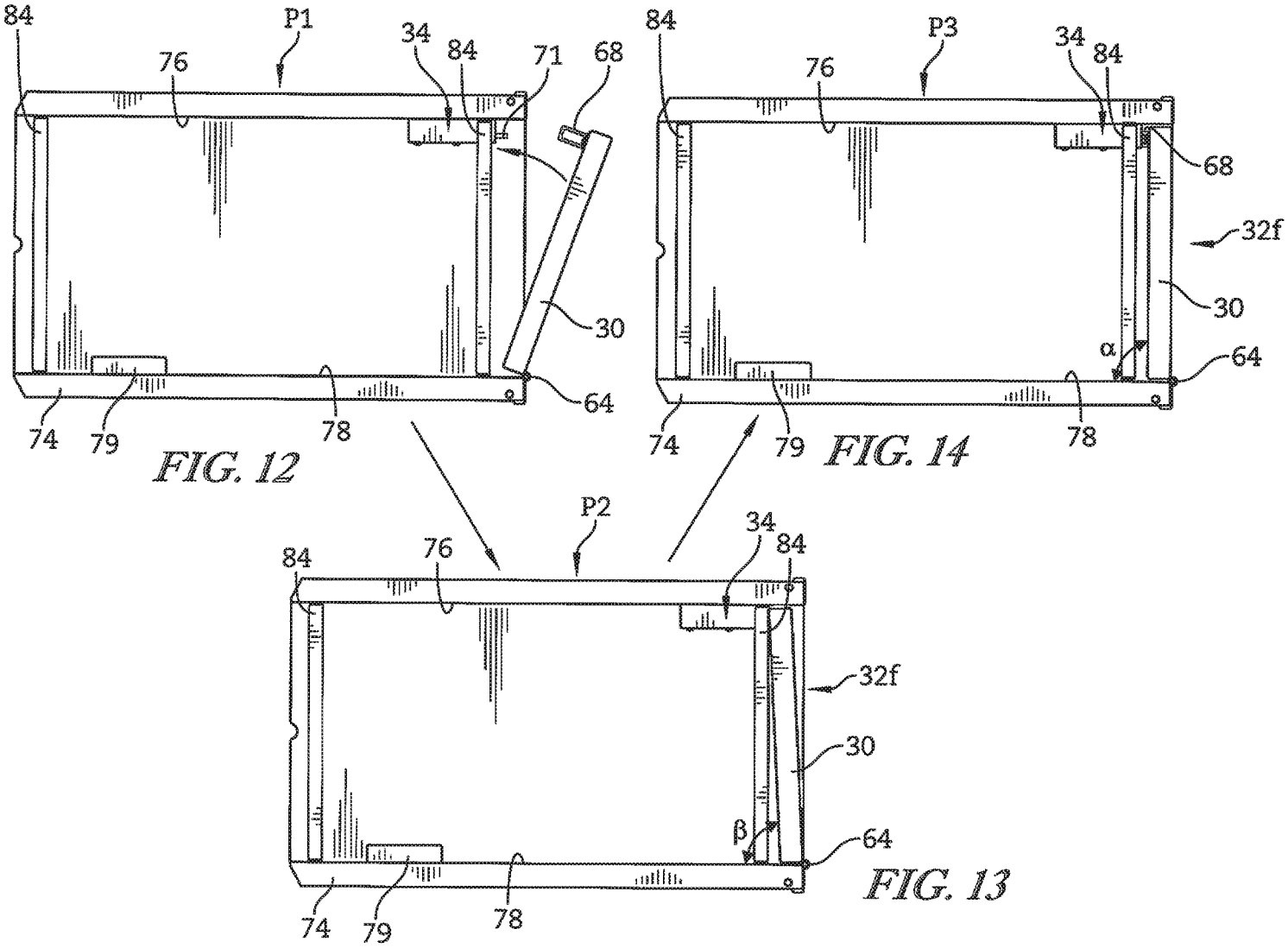
FIGS. 12-14 are diagrammatic representation of the door latching process for the modular locker of FIG. 1.
Figure 15:
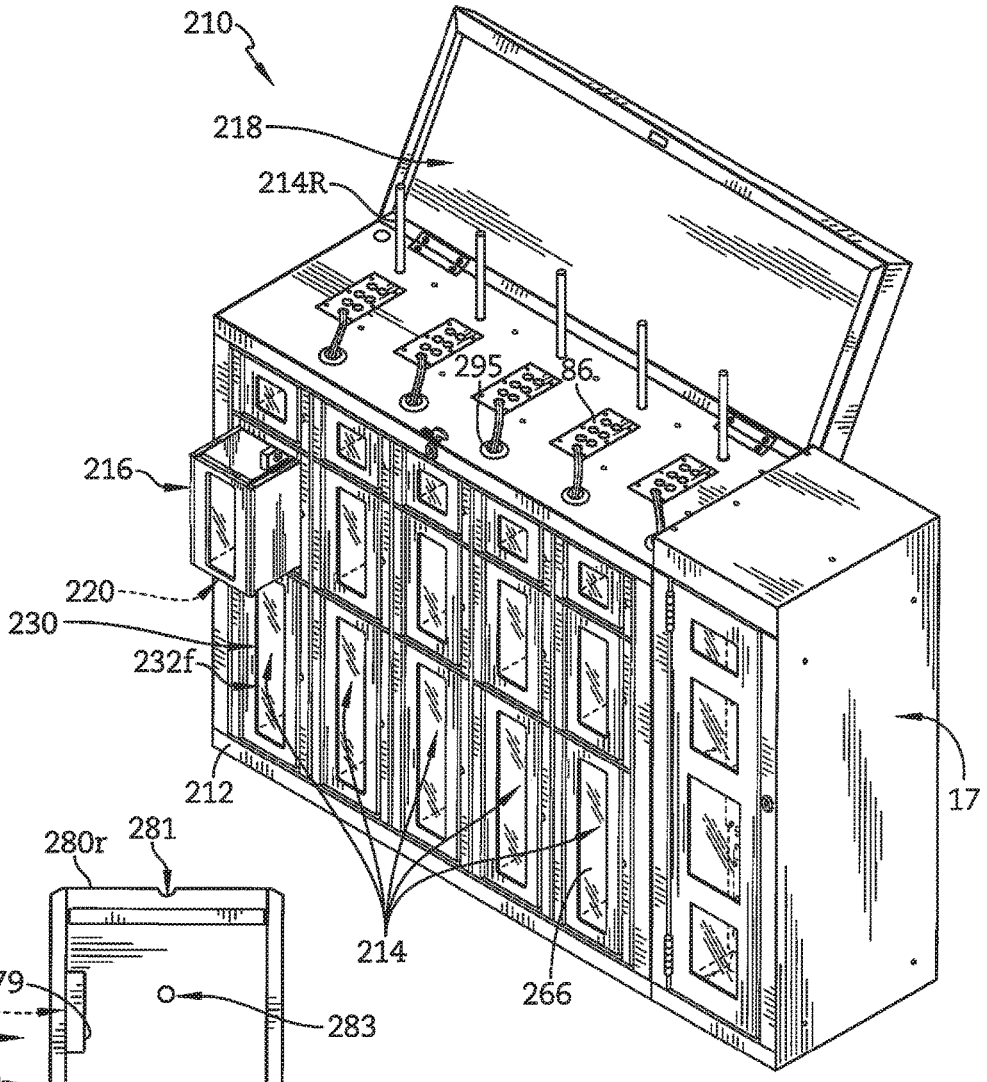
FIG. 15 is a perspective view of another embodiment of a modular locker system similar to the modular locker system of FIG. 1 and showing multiple locker towers supported by the locker base.

A modular locker system 10 in accordance with the present disclosure includes a locker base 12, a locker tower 14, and modular lockers 16, as shown in FIGS. 1 through 3. The modular locker system 10 allows users to access the contents of a modular locker 16 by inputting a code or through automatic recognition of an identifier associated with the user such as a barcode or RFID badge, as examples, in a user control unit 17 to unlock a door 30. For example, the contents of the modular lockers 16 can include consumer goods, tools, and computing peripherals, each of which may require a specific sized modular locker 16. As such, the modular lockers 16 can be made in a variety of sizes that can be interchangeably inserted in the locker tower 14. A first embodiment of a modular locker system 10 is shown in FIGS. 1-14. A second embodiment of a modular locker system 210 is shown in FIG. 15.

Figures 7, 8:
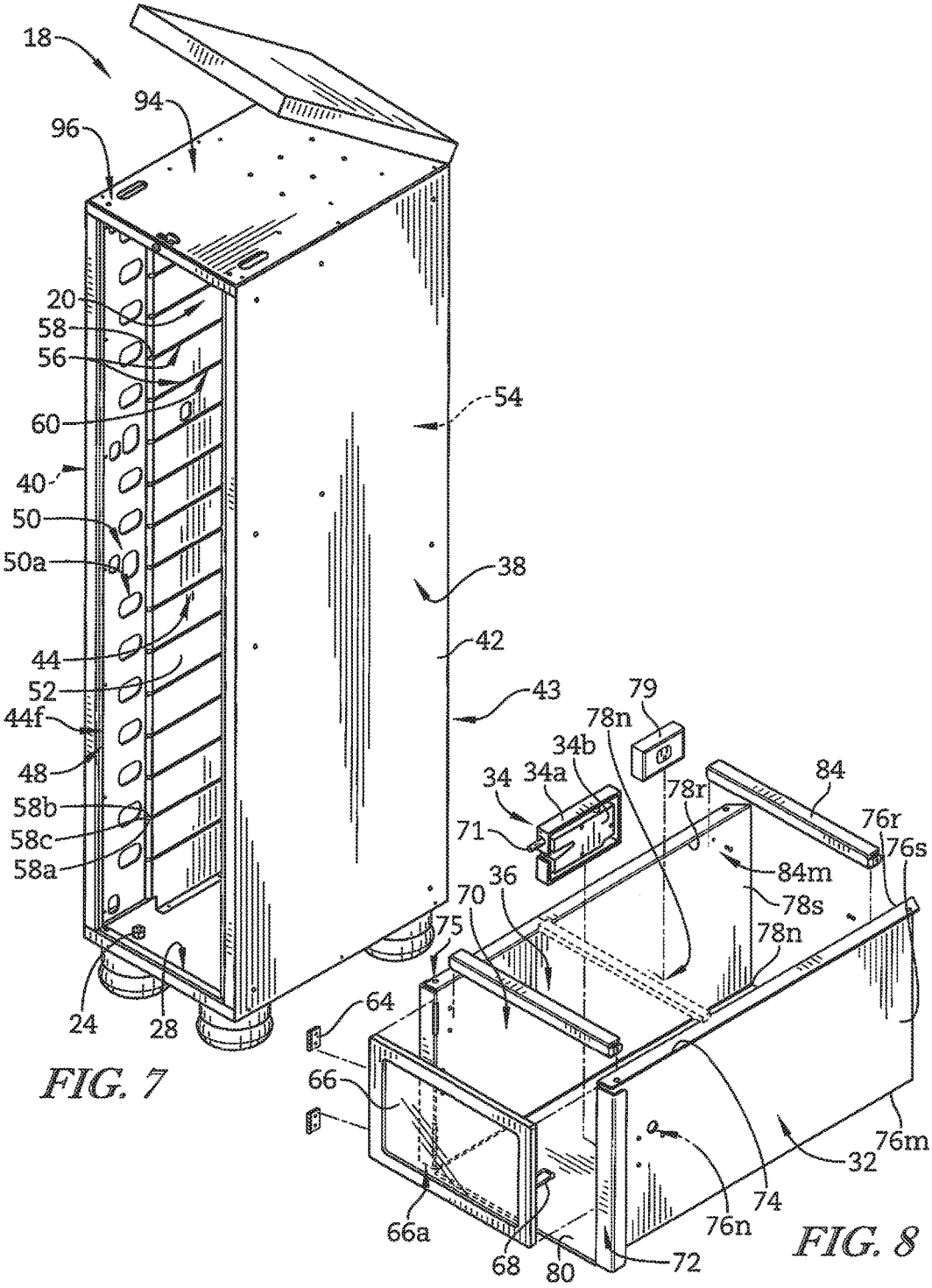
FIG. 7 is a perspective view of the locker tower and locker base of the modular locker system of FIG. 1.
FIG. 8 is an exploded assembly view of the modular locker of FIG. 1.

The locker base 12 of the modular locker system 10 supports the locker tower 14, as shown in FIGS. 1 and 3. The locker tower 14 extends vertically away from the locker base 12 towards a locker tower upper compartment 18 and is formed to include a modular locker storage area 20, as shown in FIG. 7. The modular lockers 16 can be interchangeably arranged within the modular locker storage area 20 as needed.

Figure 6:
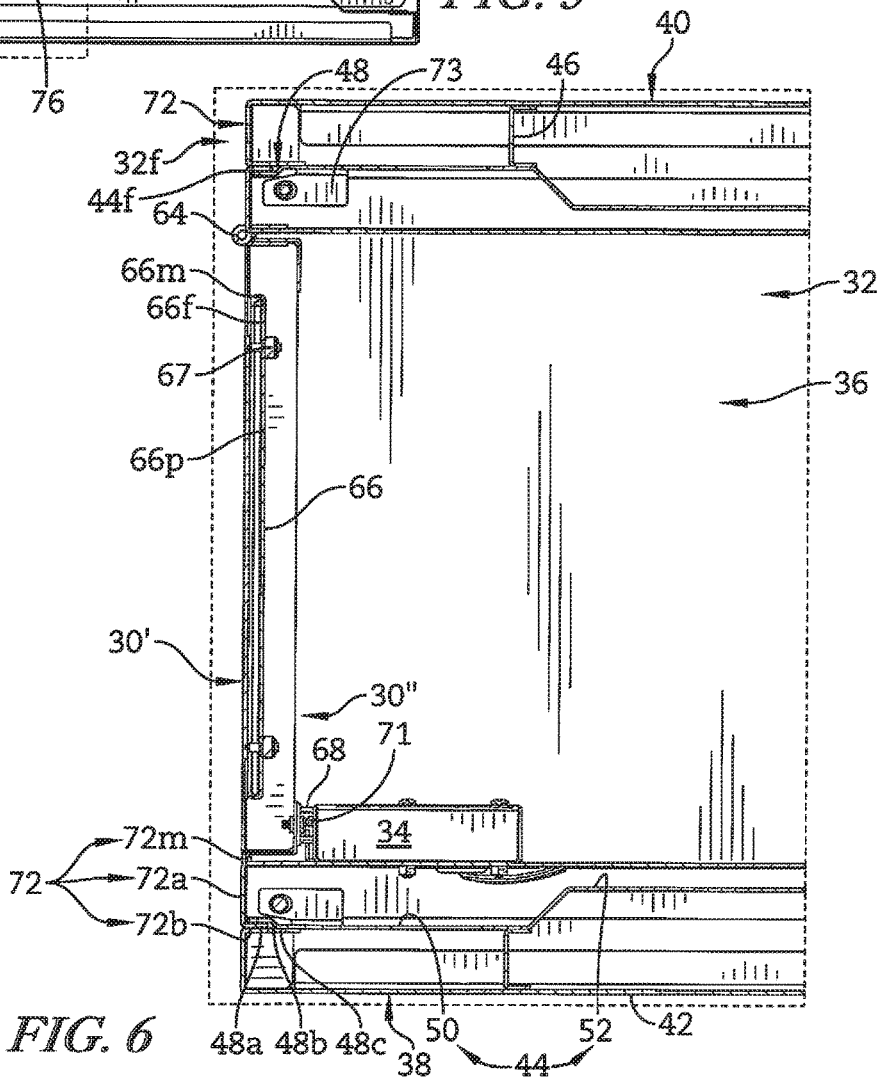
FIG. 6 is a detail view of the cross-sectional view of FIG. 5; showing the interaction of the locker tower mount and the locker mount receiver.

The modular lockers 16 each include a door 30, a locker compartment 32, and a lock assembly 34, as shown in FIGS. 2, 6, and 8. The door 30 is hingedly attached to the locker compartment 32 and is arranged to control access to an interior product storage region 36 formed in the locker compartment 32, as shown in FIGS. 12 through 14. The lock assembly 34 is located within the locker compartment 32 and is configured to secure the door 30 to the locker compartment 32 to block access to the contents located within the interior product storage region 36.

To accommodate a variety of goods located within the interior product storage region 36, the modular lockers 16 can be produced in incremental heights, as shown in FIGS. 1 through 3. For example, a modular locker 16 can have a height that is approximately the height of the distance between two vertically adjacent rail receivers 56. Alternatively, a modular locker 16 can have height that spans several vertically adjacent rail receivers 56, as shown in FIG. 3. In an embodiment, a modular locker 16 has a height that is generally the same as the vertical distance between two vertically spaced-apart rail receivers 56. In another embodiment, a modular locker 16 has a height that is generally the same as the vertical distance between three vertically spaced-apart rail receivers 56. It is within the scope of the present disclosure for the modular locker 16 to have a height that can span any number of vertically spaced-apart rail receivers 56.

The door 30 of the modular locker 16 includes a hinge 64, optionally a window 66, and a hook 68, as shown in FIGS. 6 and 8. The hinge 64 is located along an exterior surface 30' of the door 30 and couples the door 30 to the front face **32*f* of the modular locker 16, as shown in FIG. 2. The window 66 is optionally included in the door 30 and allows users to view the contents of the interior product storage region 36. The hook 68 is located on an interior surface 30" of the door 30 and secures the door 30 to the lock 34*a*, as shown in FIG. 6. Upon a user unlocking the modular locker 16, the hook 68 is released from the lock 34*a* and the door 30 pivots relative to the locker tower 14 on the hinge 64**.

The hinge 64 cooperates with the lock **34*a* for securing the door 30 to the modular locker 16, as shown in FIGS. 12-14. When closing the door 30 from an open position P1, as shown in FIG. 12, a user moves the door 30 to a latching position P2 to secure the door 30 to the lock 34*a*, as shown in FIG. 13, the door 30 then pivots to the locked position P3, as shown in FIG. 14. When a user closes the door 30, a lost motion effect allows the door 30 to pivot beyond the normally closed position P3 to reach the latching position P2 to reduce false latching. When the door 30 is secured to the lock 34*a* in the locked position P3, the door 30 is generally parallel with the front face 32*f* of the locker compartment 32. In general, the door 30 forms a locked angle a that is about 90° relative to the second locker side wall 78. When the door 30 is in the locking position P2, the door 30 forms a locking angle $\beta$ relative to the second locker side wall 78** that is generally less than the locked angle $\alpha$.

The window 66 includes a window mount **66*m*, a window frame 66*f* and a window pane 66*p*, as shown in FIGS. 4 and 6. The window mount 66*m* surrounds an aperture 66*a*** formed in the door 30. The window pane 66*p* is sized to overlie the aperture 66*a*. The window frame 66*f* cooperates with the window mount 66*m* to locate and secure the window pane 66*p* to the door 30 with fasteners 67.

Figure 10:
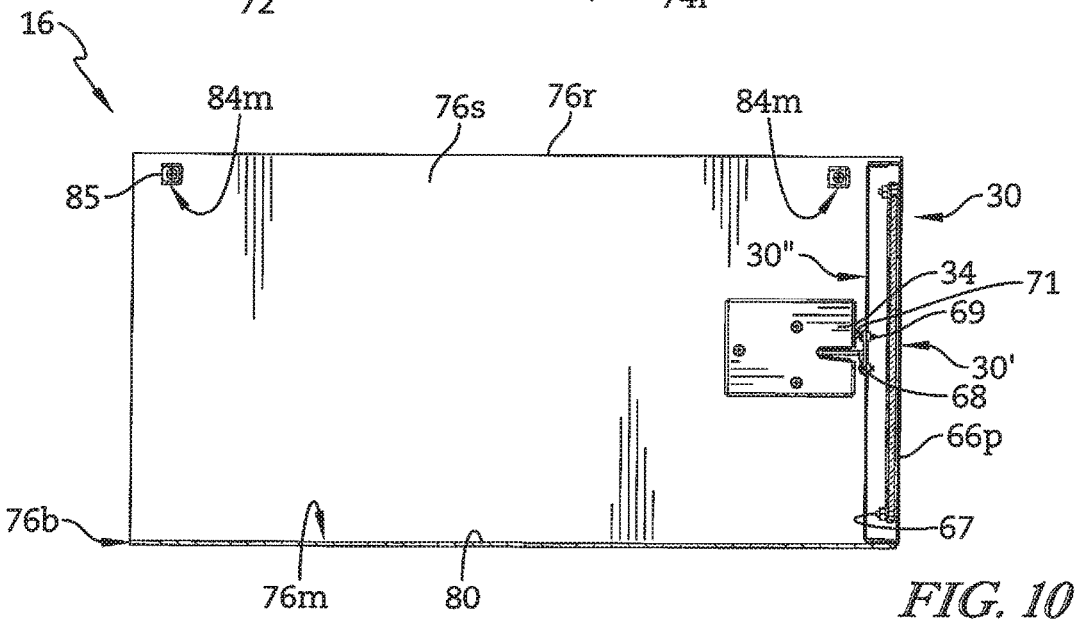
FIG. 10 is a cross-sectional view of the modular locker of FIG. 9 taken along line 10-10 of FIG. 7.
Figure 11:
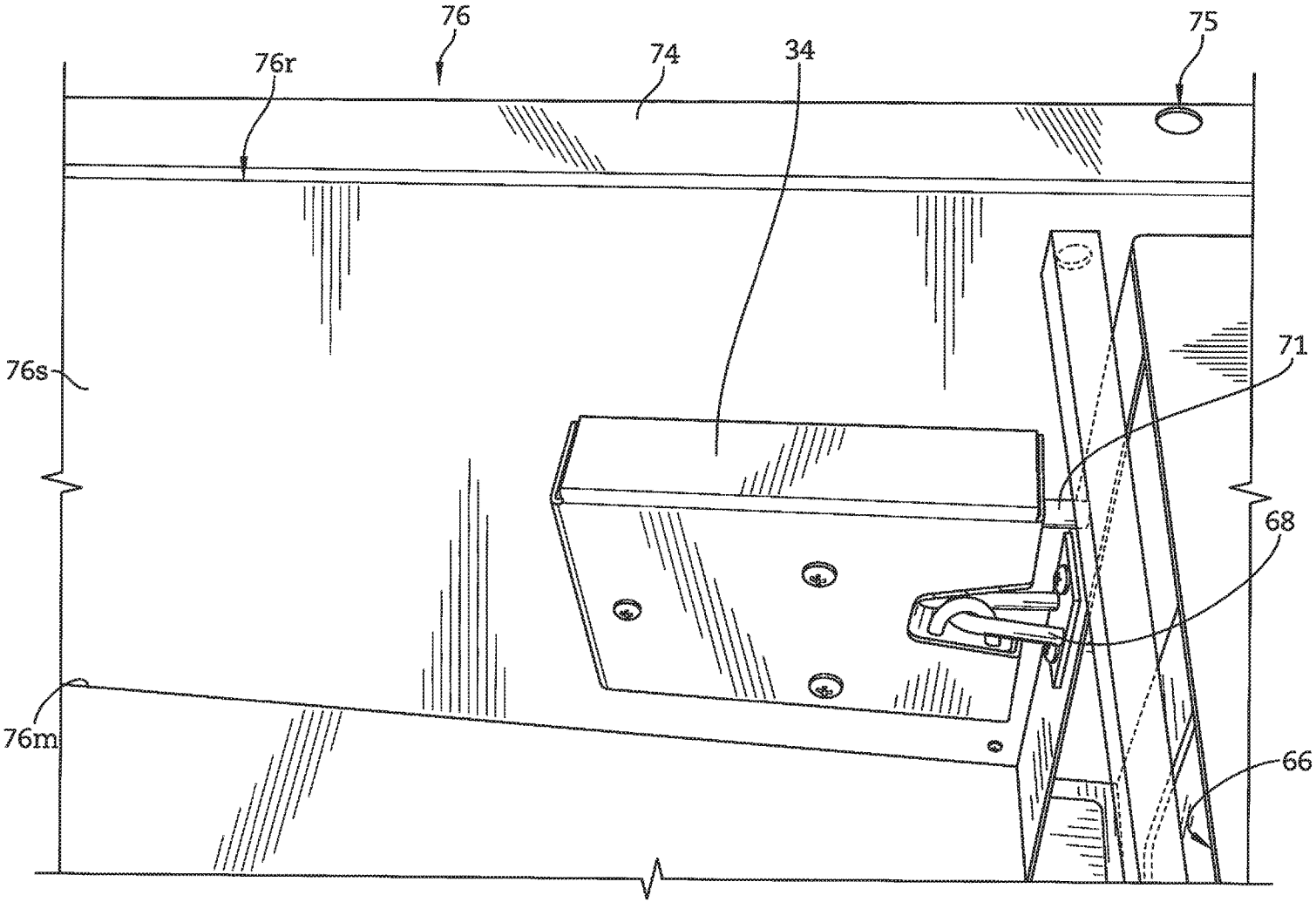
FIG. 11 is a perspective view of the lock of the modular locker of FIG. 1.

The hook 68 is located on the interior surface 30" of the door 30, as shown in FIG. 10. The hook 68 extends in rearward direction at a generally perpendicular angle to the door 30 to interact with the lock 34*a*. Illustratively, the hook 68 is generally c-shaped, although any other type of securable hook shape can be used to secure the door 30 to the lock 34*a*, as shown in FIG. 11. The hook 68 is coupled to the door 30 with a set of fasteners 69, or alternatively a weld. In an illustrative embodiment, the hook 68 is adjustable to properly seat with the lock 34*a*.

Figure 9:
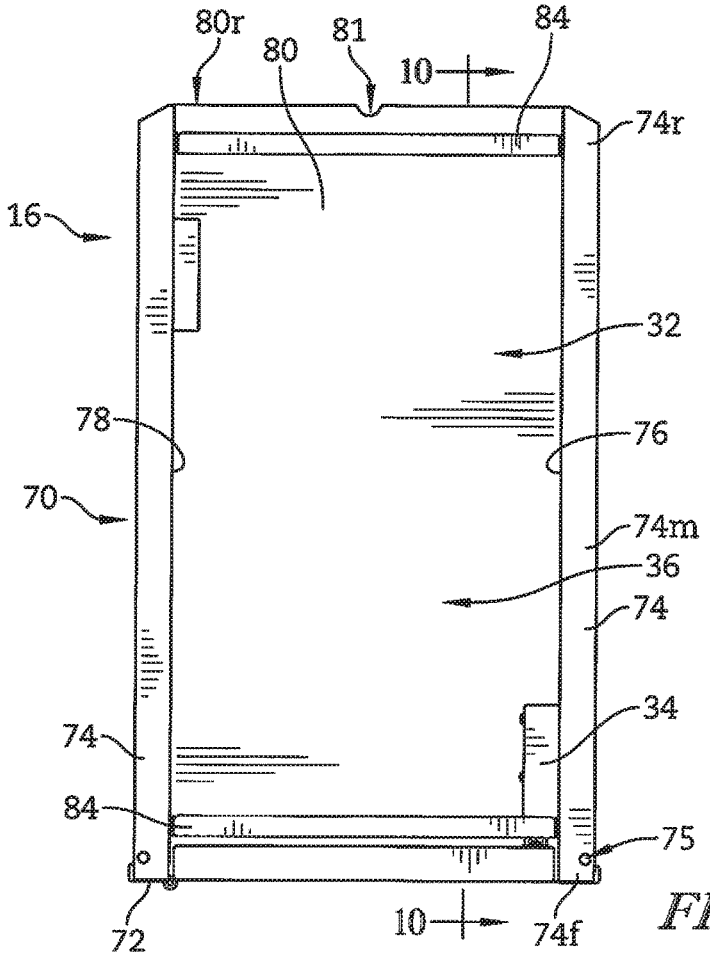
FIG. 9 is a top plan view of the modular locker of FIGS. 1 and 8.

The locker compartment 32 includes a locker body 70, a locker tower mount 72, and a rail 74, as shown in FIGS. 6, 8, and 9. The locker body 70 is formed to include the interior product storage region 36 for storing products to a user. The locker tower mount 72 forms the front face 32*f* of the locker compartment 32 to horizontally locate the modular locker 16 in the locker tower 14. The rail 74 extends in a rearward direction from the locker tower mount 72 to vertically locate the modular locker 16.

Figure 5:
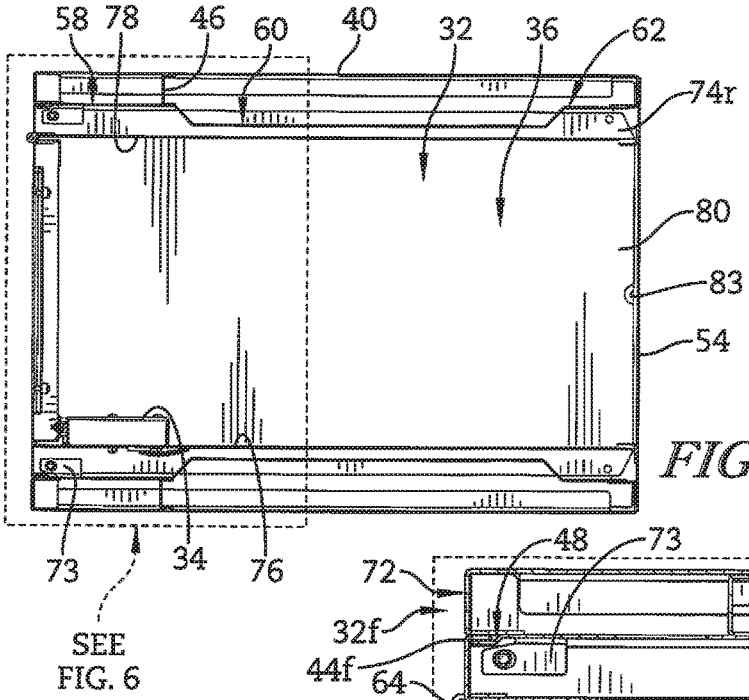
FIG. 5 is a cross-sectional view looking from above at the modular locker system of FIG. 1 taken along line 5-5 of FIG. 1.

The locker body 70 is generally U-shaped and includes a first locker side wall 76, a second locker side wall 78, and a locker bottom 80 that extends between and interconnects the first locker side wall 76 and the second locker side wall 78, as shown in FIGS. 5 and 6. Each of the first locker side wall 76 and the second locker side wall 78 are generally perpendicular to the locker bottom 80 and extend vertically away from the locker bottom 80 towards the rail 74.

The first locker side wall 76 includes a locker bottom mount 76*m*, a side panel 76*s*, a rail mount 76*r*, and a lock mount 76*n*, as shown in FIGS. 5, 6, 8 through 10. The locker bottom mount 76*m* extends along bottom edge 76*b* of the first locker side wall 76. The rail mount 76*r* extends along top edge 76*t* of the first locker side wall 76, as shown in FIG. 10. The side panel 76*s* extends between and interconnects the locker bottom mount 76*m* and the rail mount 76*r*. The lock mount 76*n* is configured to receive the lock assembly 34 to locate the lock assembly 34 on the first side panel 76*s* between the locker bottom mount 76*m* and the rail mount 76*r*.

The second locker side wall 78 includes a locker bottom mount 78*m*, a side panel 78*s*, a rail mount 78*r*, and an optional electrical outlet mount 78*n*, as shown in FIGS. 5, 6, 8, and 9. The locker bottom mount 78*m* extends along bottom edge 78*b* of the second locker side wall 78. The rail mount 78*r* extends along top edge 78*t* of the second locker side wall 78. The side panel 78*s* extends between and interconnects the locker bottom mount 78*m* and the rail mount 78*r*. The optional electrical outlet mount 78*n* is configured to receive an electrical outlet 79 to locate the electrical outlet 79 on the second side panel 78*s* between the locker bottom mount 78*m* and the rail mount 78*r*, as shown in FIG. 8.

The locker bottom 80 extends between and interconnects the first locker side wall 76 and the second locker side wall 78 and includes a rear edge 80*r* formed to include an aperture 81, as shown in FIG. 9. Illustratively, the aperture 81 is semi-circular and can locate an optional light source 83 therein. The optional light source 83 can be used to illuminate the interior product storage region 36 so the contents of the modular locker 16 can be viewed by a user through the window 66.

The locker tower mount 72 extends outwardly away from the locker compartment 32 towards the side walls 38, 40, as shown in FIG. 6. The locker tower mount 72 is generally L-shaped an includes a locker compartment mount 72*m*, a first segment 72*a*, and a second segment 72*h*, as shown in FIG. 6. The locker compartment mount 72*m* extends between and interconnects the first segment 72*a* with the locker compartment 32. The first segment 72*a* extends outwardly from the locker compartment 32 towards the side wall 38 at a generally perpendicular angle to the first locker side wall 76. Illustratively, first segment 72*a* can form a portion of the front face 32*f* of the modular locker 16 and locates the rail 74 between the first segment 72*a* and the back wall 54 of the locker tower 14. Second segment 72*b* extends in a rearward direction away from the front face 32*f* towards the back wall 54 at a generally perpendicular angle to the first segment 72*a* to form a generally L-shape relative to the locker compartment 32. When the modular locker 16 is located within the locker tower 14 the second segment 72*b* is located between the locker mount receiver 48 of the notched inner side wall 44 and the outer side wall 42. Illustratively, the locker tower mount 72 cooperates with a side walls 38,40 to locate a portion of the locker mount receiver 48 therebetween.

The rails 74 extend in a rearward direction from the locker tower mount 72 towards the back wall 54 of the locker tower 14 along the top edge 76*t*, 78*t* of each of the first and second side walls 76, 78, as shown in FIGS. 5 and 8. The rail 74 is generally perpendicular to the locker sides 76,78 and extends horizontally away from the locker compartment 32 towards the notched inner side wall 44. The rail 74 includes a rear segment 74*r*, a front segment 74*f*, and a middle segment 74*m* that extends between and interconnects the rear segment 74*r* and the front segment 74*f*, as shown in FIGS. 8 through 10. A portion of the middle segment 74*m* is supported by the bottom edge 56*b* of the rail receiver 56 so that the portion of the middle segment 74*m* is located between the top edge 56*t* and the bottom edge 56*b* of the rail receiver 56 to vertically secure the modular locker 16 to the locker tower 14, as shown in FIG. 4. A locking rod aperture 75 is formed in the rail 74 to receive a locking rod 14R to secure the modular locker 16 to the locker tower 14.

The lock assembly 34 includes a lock 34*a*, a lock cover 34*b*, and a rod 71 The lock cover 34*b* is configured to locate the lock 34*a* between the lock cover 34*b* and the first locker sidewall 76 to prevent any damage to the lock 34*a* during use. The lock 34*a* secures the door 30 to the locker compartment 32. The lock 34*a* is electronically controlled by a lock control unit 86 located in the locker tower upper compartment 18, as shown in FIG. 2. When a user inputs a correct code, the lock control unit 86 sends a signal to lock 34 to release the hook 68 of the door 30. The rod 71 is spring loaded and provides a force to the door 30 to partially open the door 30. The lock 34*a* is connected to the lock control unit 86 via cabling that extends through the cabling section 50 of the locker tower 14. Illustratively, the lock 34*a* is coupled to the lock mount 76*n* of the first locker side wall 76, as shown in FIG. 8. In an illustrative embodiment, the lock 34*a* is a Shenzhen Red Leaf Lock Technology Development Co., Ltd., model #HY-J10.

The locker compartment 32 can further include a compartment braces 84 for additional stability, as shown in FIG. 8. The compartment braces 84 extends between brace mounts 84*m* included in the locker sides 76, 78. The compartment braces 84 can be fastened to the brace mounts 84*m* with fasteners 85. The compartment braces 84 minimize the twisting action of locker compartment 32. While the illustrative embodiment shows two compartment braces 84, any number of compartment braces are contemplated to minimize twisting.

The locker tower 14 includes the modular locker storage area 20, the locker tower upper compartment 18, and a locker tower floor 28, as shown in FIGS. 1 and 7. The locker tower floor 28 extends between and interconnects the locker tower 14 with the locker base 12, as shown in FIG. 3. The locker tower upper compartment 18 is located in spaced-apart relation to the locker tower floor 28 to locate vertically the modular locker storage area 20 therebetween. The modular lockers 16 are secured to the locker tower 14 by a set of locking rods 14R that extend downwardly from the locker tower upper compartment 18 through the locking tabs 73 and the modular lockers 16 to the locker tower floor 28. The locking rods 14R can be comprised of metal, or alternatively can be comprised of a flexible fiberglass.

The modular locker storage area 20 is located between a first side wall 38 and a second side wall 40 of the locker tower 14, as shown in FIG. 7. The first side wall 38 and the second side wall 40, each include an outer side wall 42, a notched inner side wall 44 located in spaced-apart relation to the outer side wall 42, and a support bar 46 located between the outer side wall 42 and the notched inner side wall 44, as shown in FIGS. 5 and 6. The outer side wall 42 is generally flat and forms an exterior side 43 of the locker tower 14, as shown in FIG. 7. The notched inner side wall 44 is configured to receive the modular lockers 16.

The notched inner side wall 44 includes a locker mount receiver 48, a cabling section 50, and a rail receiver section 52, each of which extend from the locker tower floor 28 to the locker tower upper compartment 18, as shown in FIGS. 4 and 7. The locker mount receiver 48 is located along a front edge 44*f* of the notched inner side wall 44 and is configured to receive the locker tower mount 72 of the modular locker 16 to locate a portion of the locker tower mount 72 between the locker mount receiver 48 and the outer side wall 42. The cabling section 50 is located between the locker mount receiver 48 and the rail receiver section 52. The cabling section 50 is formed to include a plurality of apertures 50*a* that allow electrical cables to pass through, for example, to the lock 34*a*. The rail receiver section 52 is located between the cabling section 50 and the back wall 54 and is formed to include a plurality of rail receivers 56.

The notched inner side wall 44 can further include locking tabs 73 extending from the cabling section 50 towards the modular locker 16. The locking tabs 73 are configured to locate a portion of a locking rod 14R through an aperture formed in the locking tab 73. The locking tabs 73 cooperate with the locking rod aperture 96 formed in the rails 74 of the modular locker 16 to secure the modular locker 16 to the locker tower 14. In an embodiment, the locker tower 14 includes a plurality of locking tabs 73 equidistantly-spaced apart vertically and located between the modular lockers 16.

The locker mount receiver 48 includes a first segment 48*a*, a second segment 48*b*, and a third segment 48*c*, as shown in FIG. 6. The first segment 48*a* extends in a rearward direction from the locker tower mount 72 and is generally parallel with the rail 74 of the modular locker 16. The second segment 48*h* extends in a rearward direct from first segment 48*a* towards the cabling section 50 at a generally obtuse angle. The third segment 48*c* extends in a rearward direction from second segment 48*b* to interconnect the locker mount receiver 48 with the cabling section 50 and is generally parallel with the first segment 48*a*. When the modular locker 16 is located within modular locker storage area 20, the first segment 48*a* is located between the second segment 72*b* of the locker tower mount 72 and the locker compartment 32. Illustratively, the first segment 48*a* has a length, and the second segment 72*b* of the locker tower mount 72 has a generally similar length, as shown in FIG. 6.

The cabling section 50 is located between the locker mount receiver 48 and the rail receiver section 52, as shown in FIG. 7. The cabling section 50 is formed to include a plurality of apertures 50*a* to allow the cabling to connect the lock 34*a* to the lock control unit 86. Illustratively, the apertures 50*a* have a generally ovoid shape.

The rail receiver section 52 extends in a rearward direction from the cabling section 50 towards the back wall 54, as shown in FIGS. 6 and 7. The rail receiver section 52 includes a plurality of rail receivers 56 located in spaced-apart vertically relation. The rail receiver section 52 includes a locker entry section 58, a locker body section 60, and an locker exit section 62, as shown in FIGS. 5 and 7. The locker entry section 58 extends between and interconnects the locker body section 60 with the cabling section 50. The locker entry section 58 extends in a rearward direction at an angle so that the distance between the locker body section 60 of the first side wall 38 and the locker body section 60 of the second side wall 40 is generally less than the distance between the cabling section 50 of the first side wall 38 and the cabling section 50 of the second side wall 40. The locker body section 60 extends between and interconnects the locker entry section 58 and the locker exit section 62 and is configured to support the modular locker 16. The locker exit section 62 extends in a rearward direction from the locker body section 60 towards the hack wall 54.

Each mil receiver 56 is configured to receive a portion of the mil 74 of the modular locker 16 to locate vertically the modular locker 16, as shown in FIG. 4. In an illustrative embodiment, the rail receivers 56 of the notched inner side wall 44 are about 4" apart, however any suitable distance is contemplated. Therefore, depending on the height of the modular lockers 16, only a selection of rail receivers 56 may be receive a rail 74 when the modular lockers 16 are arranged in the locker tower 14.

Upon inserting the modular locker 16, the rail 74 of the modular locker 16 interacts first with the locker entry section 58, as shown in FIGS. 5 and 7. When viewed from the rear of the locker tower 14, the locker entry section 58 is generally triangular in shape and includes a first side 58*a* having a length, a second side 58*b* having a second length, and a third side 58*c* having a third length, as shown in FIG. 4. First side 58*a* extends vertically and is generally parallel with the side walls 38, 40. Second side 58*b* and third side 58*c* extend inwardly away from first side 58*a* towards the each other and the opposite side wall 38, 40. Second side 58*b* and third side 58*c* generally have the same length which is greater than the length of the first side 58*a*.

The locker body section 60 extends in a rearward direction from the locker entry section 58 towards the locker exit section 62, as shown in FIG. 7. The locker body section 60 supports the rail 74 of the modular locker 16 when the modular locker 16 is fully inserted in the locker tower 14.

The locker exit section 62 extends rearwardly from the locker body section 60 towards the back wall 54, as shown in FIG. 5. The locker exit section 62 extends at an angle away from the modular locker 16 so a rear segment 74*r* of the rail 74 is unsupported by the notched inner side wall 44 when the modular locker 16 is located in the locker tower 14, as shown in FIG. 5.

The locker tower upper compartment 18 includes the lock control unit 86, an upper compartment lid 88, an upper compartment lock 90, and is formed to include an upper compartment storage area 92, as shown in FIGS. 2 and 3. The upper compartment lid 88 is hingedly connected to the locker tower 14 to selectively allow access to the upper compartment storage area 92. The upper compartment lid 88 is secured to the locker tower 14 by the upper compartment lock 90. Illustratively, the lock control unit 86 is located within the upper compartment storage area 92.

The locker tower upper compartment 18 further includes an upper compartment floor 94 that extends between and interconnects the locker tower 14 and the upper compartment storage area 92, as shown in FIGS. 2 and 3. In an embodiment, the lock control unit 86 is coupled to the upper compartment floor 94. The upper compartment floor 94 is formed to include a cabling aperture 95 that allows cables from the lock control unit 86 to pass therethrough to the locker tower 14. In an embodiment, the upper compartment floor 94 is further formed to include locking rod apertures 96 that are configured to allow the locking rods 14R to pass therethrough to secure the modular lockers 16 to the locker tower 14.

The locker tower floor 28 is located between a bottom edge 44*b* of the notched inner side wall 44 and the locker base 12, as shown in FIGS. 3 and 7. The locker tower floor 28 includes a locker base mount 28*b*, and side wall mounts 28*s*. The locker base mount 28*b* extends between and interconnects the locker tower floor 28 and the locker base 12. The side wall mounts 28*s* extends between and interconnects the locker tower floor 28 and the side walls 38,40. The locker base mount 28*b*, and the side wall mounts 28*s* cooperate to secure the locker tower 14 to the locker base 12.

The locker base 12 includes a locker base platform 26, at least one locker base foot 22, and at least one fastener 24, as shown in FIGS. 1 through 3. The locker base platform 26 is located between the locker tower 14 and the locker base foot 22. The locker base foot 22 is secured to the locker base platform 26 with a fastener 24 and is configured to support the modular locker system 10 Illustratively, the locker base 12 of the modular locker system 10 includes four feet 22, however any appropriate number of feet 22 can be used to support the locker tower 14.

In another embodiment, a modular locker system 210 includes a locker base 212, a plurality of locker towers 214, and modular lockers 216, as shown in FIG. 15. Modular locker system 210 is similar to modular locker system 10 and uses modular lockers 216. Modular locker system 210 includes a plurality of locker towers 214 that are horizontally arranged along locker base 212 and the locker tower upper compartment 218. The modular locker system 210 allows users to access the contents of a modular locker 216 by inputting a code or through automatic recognition of an identifier associated with the user such as a barcode or RFID badge, as examples, into a user control unit 217 to unlock a locker door 230. The modular locker system 210 can optionally include a user control unit 17.

The locker base 212 of the modular locker system 210 supports the plurality of locker towers 214, as shown in FIGS. 15. Each of the locker towers 214 of the plurality of locker towers 214 extend vertically away from the locker base 212 towards a locker tower upper compartment 218 and is formed to include a modular locker storage area 220, as shown in FIG. 15. The modular lockers 216 can be interchangeably arranged within the modular locker storage area 220 as needed.

Figure 16:
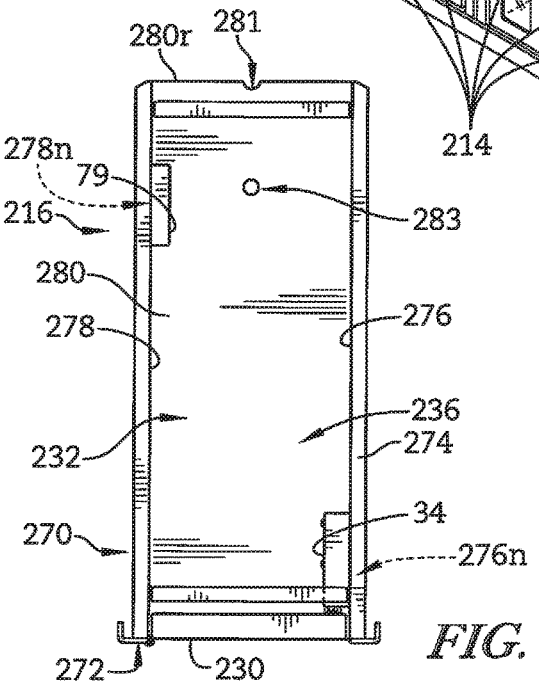
FIG. 16 is a top plan view of the modular locker of FIG. 16 showing the locking rod aperture located in the locker bottom.

The modular lockers 216 each include a door 230, a locker compartment 232, and a lock assembly 34, as shown in FIG. 16. The door 230 is hingedly attached to the locker compartment 232 and is arranged to control access to an interior product storage region 236 formed in the locker compartment 232, as shown in FIG. 16. The lock assembly 34 is located within the locker compartment 232 and is configured to secure the door 230 to the locker compartment 232 to block access to the contents located within the interior product storage region 236.

The locker compartment 232 includes a locker body 270, a locker tower mount 272, and a rail 274, as shown in FIG. 16. The locker body 270 is formed to include the interior product storage region 236 for storing products to a user. The locker tower mount 272 forms the front face 232*f* of the locker compartment 232 to horizontally locate the modular locker 216 in the locker tower 214. The rail 274 extends in a rearward direction from the locker tower mount 272 to vertically locate the modular locker 216 within the locker tower 214.

The locker body 270 is generally U-shaped and includes a first locker side wall 276, a second locker side wall 278, and a locker bottom 280 that extends between and interconnects the first locker side wall 276 and the second locker side wall 278, as shown in FIG. 16. Each of the first locker side wall 276 and the second locker side wall 278 are generally perpendicular to the locker bottom 280 and extend vertically away from the locker bottom 280 towards the rail 274.

The lock mount 276*n* included in the first locker side wall 276 is configured to receive the lock assembly 34 to locate the lock assembly 34 on the first side wall 276. An optional electrical mount 278*n* is configured to receive an electrical outlet 79 to locate the electrical outlet 79 on the second side wall 278.

The locker bottom 280 extends between and interconnects the first locker side wall 276 and the second locker side wall 278 and includes a rear edge 280*r* formed to include an aperture 281, as shown in FIG. 16. Illustratively, the aperture 281 is semi-circular and can locate an optional light source 83, as shown in FIG. 16. The optional light source 83 can be used to illuminate the interior product storage region 236 so the contents of the modular locker 216 can be viewed by a user through the window 266. The locker bottom 280 further includes a locking rod aperture 283 to locate a portion of the locking rod 214R within the locker bottom 280 when the modular locker 216 is located within the locker tower 214.

The locker tower mount 272 extends outwardly away from the locker compartment 232 towards the side walls 238, 240, as shown in FIGS. 15 and 16. Generally, the locker tower mount 272 is similar to the locker tower mount 72 and includes the same structure to cooperate with a side walls 238,240 to locate a portion of the locker mount receiver 248 therebetween.

The rails 274 extend in a rearward direction from the locker tower mount 272 towards the back wall 254 of the locker tower 14 along the first and second side walls 276, 278, as shown in FIG. 16. The rail 274 is generally perpendicular to the locker sides 276,278 and extends horizontally away from the locker compartment 232 towards the notched inner side wall 244.

Although this disclosure refers to specific embodiments, it will be understood by those skilled in the art that various changes in form and detail may be made without departing from the subject matter set forth in the accompanying claims.

We claim:

1. A modular locker system for dispensing products comprising a locker base, a locker tower supported by the locker base, the locker tower comprising a first side wall and second side wall spaced apart from the first side wall, and each of the first side wall and the second side wall extends from the locker base towards a locker tower upper compartment, and a modular locker located between the first side wall and the second side wall, wherein the modular locker is secured to the locker tower with a set of locking rods that extend vertically down through the locker tower upper compartment located at a top of the locker tower through the modular locker, and wherein the set of locking rods are removable to allow the modular locker to be removed from the locker tower.

2. The modular locker system of claim 1, wherein the modular locker system includes a lock control unit and wherein the modular locker includes a door, a locker compartment formed to include an interior product storage region, and a lock assembly configured to release the door from the locker compartment in response to a signal received from the lock control unit to allow a user to access the interior product storage region.

3. The modular locker system of claim 2, wherein the locker compartment includes a first locker side wall located in spaced-apart relation to a second locker side wall, and a locker bottom arranged to extend between and interconnect the first locker side wall and the second locker side wall.

4. The modular locker system of claim 3, wherein each of the first locker side wall and the second locker side wall include a L-shaped locker tower mount located on a front face of the locker compartment configured to horizontally locate the modular locker within the locker tower and a rail extending from the front face of the modular locker to the rear of the modular locker to vertically locate the modular locker within the locker tower.

5. The modular locker system of claim 4, wherein the L-shaped locker tower mount includes a first segment coupled to the locker compartment that extends horizontally away from the locker compartment, and a second segment coupled to the first segment that extends rearwardly from the front face of the modular locker towards a back wall of the locker tower to locate a portion of a notched inner side wall between the second segment and the locker compartment.

6. A modular locker system for dispensing products comprising, a locker base, a locker tower supported by the locker base, and a modular locker located within the locker tower, wherein the modular locker is secured to the locker tower with a set of locking rods that extend vertically down through a locker tower upper compartment located at a top of the locker tower through the modular locker, and wherein the set of locking rods are removable to allow the modular locker to be removed from the locker tower, wherein the modular locker system includes a lock control unit and wherein the modular locker includes a door, a locker compartment formed to include an interior product storage region, and a lock assembly configured to release the door from the locker compartment in response to a signal received from the lock control unit to allow a user to access the interior product storage region, wherein the locker compartment includes a first locker side wall located in spaced-apart relation to a second locker side wall, and a locker bottom arranged to extend between and interconnect the first locker side wall and the second locker side wall, wherein each of the first locker side wall and the second locker side wall include a L-shaped locker tower mount located on a front face of the locker compartment configured to horizontally locate the modular locker within the locker tower and a rail extending from the front face of the modular locker to the rear of the modular locker to vertically locate the modular locker within the locker tower, and wherein the rail is coupled generally perpendicularly along a top edge of the first locker side wall and includes a front segment, a rear segment, and a middle segment configured to extend between and interconnect the front segment with the rear segment, and the front segment is formed to include a locking rod aperture configured to locate a portion of a locking rod of the set of locking rods therein.

7. The modular locker system of claim 6, wherein the rail extends horizontally away from the locker compartment towards a notched inner side wall of the locker tower so that the middle segment lies within a rail receiver to vertically support the modular locker.

8. The modular locker system of claim 7, wherein the rail receiver of the notched inner side wall includes a top edge and a bottom edge arranged to locate a portion of the rail therebetween.

9. The modular locker system of claim 6, wherein the locker compartment further includes a compartment brace that extends between the first locker side wall and the second side wall.

10. The modular locker system of claim 6, wherein the locker bottom is formed to include an aperture configured to receive a portion of a locking rod of the set of locking rods to secure the modular locker within the locker tower.

11. The modular locker system of claim 6, further including an electrical outlet coupled to the second locker side wall.

12. The modular locker system of claim 6, wherein the lock assembly includes a lock including a latch and a rod, and a lock cover mounted over the lock to locate the lock between the lock cover and a side wall, wherein the rod is configured to apply a force to the door to partially open the door when the latch releases the door.

13. The modular locker system of claim 6, wherein the door is coupled to a front face of the locker compartment with a hinge to form a locked angle that is about 90 degrees relative to second side wall of the locker compartment.

14. The modular locker system of claim 13, wherein the door and second side wall form a locking angle that is generally less than the locked angle to latch the door to the lock assembly.

15. The modular locker system of claim 6, wherein the locker tower includes a back wall, a first notched inner side wall, and a second notched inner side wall, each of the first notched inner side wall and the second notched inner side wall are configured to receive a rail from the modular locker to locate the modular locker between the first notched inner side wall and the second notched inner side wall.

16. The modular locker system of claim 15, wherein the locker tower further includes a locker tower floor located between a bottom edge of the first notched inner side wall and the locker base and the locker tower upper compartment located in spaced-apart relation to the locker tower floor to locate the modular locker between the locker tower floor and the locker tower upper compartment.

17. The modular locker system of claim 16, wherein the first notched inner side wall and the second notched inner side wall each include a plurality of rail receivers that extend in a rearward direction from a front of the locker tower to the back wall of the locker tower and are equidistantly spaced-apart between the locker tower floor and the locker tower upper compartment.

18. The modular locker system of claim 17, wherein the locker tower upper compartment includes an upper compartment lid and a compartment floor located between the upper compartment lid and the locker tower that cooperate to form an upper compartment storage region.

19. A modular locker system for dispensing products comprising, a locker base, a locker tower supported by the locker base, and a modular locker located within the locker tower, wherein the modular locker is secured to the locker tower with a set of locking rods that extend vertically down through a locker tower upper compartment located at a top of the locker tower through the modular locker, and wherein the set of locking rods are removable to allow the modular locker to be removed from the locker tower, wherein the locker tower includes a back wall, a first notched inner side wall, and a second notched inner side wall, each of the first notched inner side wall and the second notched inner side wall are configured to receive a rail from the modular locker to locate the modular locker between the first notched inner side wall and the second notched inner side wall, wherein the locker tower further includes a locker tower floor located between a bottom edge of the first notched inner side wall and the locker base and the locker tower upper compartment located in spaced-apart relation to the locker tower floor to locate the modular locker between the locker tower floor and the locker tower upper compartment, wherein the first notched inner side wall and the second notched inner side wall each include a plurality of rail receivers that extend in a rearward direction from a front of the locker tower to the back wall of the locker tower and are equidistantly spaced-apart between the locker tower floor and the locker tower upper compartment, wherein the locker tower upper compartment includes an upper compartment lid and a compartment floor located between the upper compartment lid and the locker tower that cooperate to form an upper compartment storage region, wherein the modular locker system further includes a lock control unit located within the upper compartment storage region and coupled to a portion of the compartment floor.

20. The modular locker system of claim 19, wherein the locker tower further includes a user control unit located on an outer side wall.

21. The modular locker system of claim 19, wherein the set of locking rods extend from the locker tower upper compartment to the locker base.

* * * * *